United States Patent [19]

McDaniel

[11] Patent Number: 4,513,521

[45] Date of Patent: Apr. 30, 1985

[54] TILLAGE TOOL FOR FORMING AN UNDERGROUND WATER RETENTION TUNNEL

[76] Inventor: W. F. McDaniel, Rte. 1, Box 58-A, Marland, Okla. 74644

[21] Appl. No.: 623,018

[22] Filed: Jun. 21, 1984

[51] Int. Cl.[3] ..... E02F 5/18

[52] U.S. Cl. ..... 37/193; 172/719

[58] Field of Search ..... 37/193; 172/699, 700, 172/719; 405/180, 181, 182, 183

[56] References Cited

U.S. PATENT DOCUMENTS

| | | | |
|---|---|---|---|
| 376,674 | 1/1888 | Nowell et al. | 172/699 X |
| 867,270 | 10/1907 | Himble | 37/193 X |
| 970,818 | 9/1910 | Harryman | 37/193 |
| 1,426,262 | 8/1922 | Disk | 37/193 |
| 1,457,271 | 5/1923 | Rinehart | 37/193 |
| 2,680,416 | 6/1954 | Russell | 37/193 X |
| 3,001,591 | 9/1961 | Johnson | 172/700 |
| 3,202,222 | 8/1965 | Norris | 172/699 X |
| 3,497,016 | 2/1970 | Ryan | 37/193 X |

FOREIGN PATENT DOCUMENTS

| | | | |
|---|---|---|---|
| 554150 | 2/1923 | France | 37/193 |
| 1388865 | 1/1965 | France | 172/699 |

*Primary Examiner*—Clifford D. Crowder
*Attorney, Agent, or Firm*—William R. Laney

[57] ABSTRACT

A tillage tool for forming an underground tunnel communicating with the surface by a narrow slot while effecting minimal surface tillage of the soil, the tool including a vertically extending shank plate having a lower edge joined to an elongated cylindrical mounting bar. A slotted forward cylindrical sleeve is demountably telescoped over the forward end of the mounting bar and receives the shank plate in a slot formed therein. The forward end of the cylindrical sleeve has a hardened wear plate secured thereto and positioned so that the wear plate lies in a plane extending at an acute angle to the longitudinal axis of the forward cylindrical sleeve. A rear cylindrical sleeve having a diameter equal to the forward cylindrical sleeve is demountably telescoped over the rear end of the mounting bar and has an end which abuts a rear end of the slotted forward cylindrical sleeve. A sharp edged slicer bar is detachably secured to the forward or leading edge of the shank plate.

1 Claim, 5 Drawing Figures

TILLAGE TOOL FOR FORMING AN UNDERGROUND WATER RETENTION TUNNEL

FIELD OF THE INVENTION

This invenion relates to tillage tools, and more particularly to tools of the type which have a lower portion capable of forming a substantially horizontally extending tunnel through the earth as the tool is driven forward by attachment of a shank between the tunnel forming element and an implement at the surface.

BRIEF DESCRIPTION OF THE PRIOR ART

A number of types of agricultural tools have previously been proposed, and in some cases patented, which are designed to form a subsurface tunnel extending horizontally in the earth to act as a water reservoir. In some instances, the tool functions to provide a very narrow slot which extends from the subterranean tunnel up to the surface, and provides a channel through which water can drain into the tunnel.

Some of the patents which have previously been issued on tools of this type may be described as representative of the prior art in this field.

Russell U.S. Pat. No. 2,680,416 describes an apparatus by means of which an underground drainage and irrigation opening can be formed. A vertically extending hollow knife blade is secured at its upper end to an elongated beam member and the hollow knife blade has a rounded leading edge. At its lower end, the hollow knife blade is secured to a bullet-shape mole for forming underground openings in the earth. A tapered nose is provided at the forward end of the mole. The elongated beam forms a part of a framework which is drawn forward by a tractor so that the nose of the mole penetrates the soil at a selected depth. The vertically extending knife blade forms a vertically extending slot. A reinforcing material which helps hold the soil in place is pumped through openings in the knife blade in the mole and impregnates the soil sufficiently to prevent collapse into the opening formed by the apparatus.

Harryman U.S. Pat. No. 970,818 depicts a subterranean tunneling plow. In the Harryman patent, a plow beam has a vertically extending portion which has secured to the forward or leading edge thereof, a knife having a forward cutting edge. At the lower end of the plow beam and the knife, the knife and plow beam are interlocked by a dovetailed slotted connection to a sub-soil plowshare which is in the form of an elongated cylindrical member having a tapered cutting face at its forward end. The tapered cutting face tapers downwardly and forwardly to a sharp lower forward edge. An adjustable shield is secured to a mid portion of the plow beam and projects horizontally along the ground and limits the depth to which the sub-soil plowshare may move in the earth.

The Harryman plow functions to cut a subterranean conduit or tunnel, and concurrently a slot extending into this tunnel from the surface. The shield performs the further function of smoothing over the soil at the top of the slot to prevent loose dirt from dropping into the tunnel. The knife and plowshare can be removed from the beam for sharpening, for renewal or replacement, or for other purposes.

A similar subsurface plow device for forming a subterranean tunnel connected to the surface by a narrow slot is shown in Rinehart U.S. Pat. No. 1,457,271. A horizontally extending drill of cylindrical configuration and having a tapered, bullet-shaped point at the forward end of the drill is used to form the subterranean, horizontally extending tunnel. The drill 17 is pivotally connected to a vertical rod and a vertical standard which extend downwardly from the frame of the plow. A knife edge is formed along the forward vertical edge of the vertical standard 19. The cylindrical drill can be detached from the lower end of the vertically extending standard and the vertical rod in order to repair or replace it.

A generally similar tillage machine is shown in Norris U.S. Pat. No. 3,202,222 and in Himble U.S. Pat. No. 867,270.

BRIEF DESCRIPTION OF THE PRESENT INVENTION

The tillage tool of the present invention provides an improved apparatus for providing moisture storage capcity at selected depths within the soil for dry land or irrigated farming operations, and so as to minimize disruption of the earth at the surface while providing a water retention and storage reservoir facilitating water absorption into the soil below the surface. The tillage tool of the invention will reduce soil compaction and break up "plow pan" better than conventional chisel plows.

Broadly described, the tillage tool of the invention includes a vertically extending shank plate adapted to be attached along its upper edge to a framework which can be towed behind a farm tractor or other vehicle having an adequate hitch or similar connection. The lower edge of the shank plate is joined by welding or other suitable means to an elongated solid cylindrical mounting bar which extends horizontally beneath the shank plate. A slotted forward cylindrical sleeve is demountably telescoped over the forward mounting bar, and receives the shank plate in a slot formed in the sleeve. The front end of the forward cylindrical sleeve has a hardened wear plate assembly secured thereto and positioned at an angle to the horizontal such that it can easily open an underground tunnel or horizontally extending opening into which water can be channeled and accumulated. A rear cylindrical sleeve having a diameter equal to the forward cylindrical sleeve is demountably telescoped over the rear end of the mounting bar and has an open forward end which abuts the rear end of the slotted forward cylindrical sleeve. A sharp edged slicer bar is detachably secured to the forward or leading edge of the shank plate.

The described tillage tool will form a generally horizontally extending tunnel or opening through the earth at a depth which can be selectively varied by the setting of the gauge wheels which govern the distance above the ground that the frame upon which the tillage tool is carried will be located. The tillage tool further forms a narrow, vertically extending channel which places the water storage tunnel in communication with the surface, but does not significantly disrupt or till the ground at the surface. Use of the tool lets more moisture and surface water soak into the ground so that less runoff occurs. Crop yields are thereby greatly improved in a drought-plagued growing season.

This tool can be used to provide deep tillage without disturbing preemergence chemicals which it may be desired to use in no-till or minimum tillage farming. When the tillage tool of the invention is used on a hill contour, it actually forms miniature terraces where the blade shank cuts through the earth, and these help to hold the water on the field until it has flowed into the formed tunnel and the fractured subsoil where the moisture is not exposed to wind or heat evaporation.

The tool can be used in bermuda grass sod or other grass sod by using rolling cutters which slice through the turf in front of each blade shank. Where such rolling cutters are used in advance of the blade shanks, the tool works as well as it does in cultivated soil.

An important object of the invention is to provide a tillage tool which can deep till the soil by providing horizontally extending water reservoirs or tunnels in the soil, and vertically extending channels which communicate with the water reservoirs and allow surface water to drain into the water reserrvoirs rapidly, and soak into the soil beneath the surface. Excess water from heavy rains or snows can gravitate into the tunnels rapidly and be held there until it has time to soak into the subsoil. This is particularly important on rolling fields with steep slopes, and fields that are prone to hardpan development.

A further object of the invention is to provide a ruggedly constructed tillage tool which can be used for forming horizontally extending tunnels at a selected depth in the earth in order to provide for improved natural irrigation and water supply to crops planted over the tunnels. The tool enables as much water as possible to penetrate deeply into the subsoil where it is retained and is readily available to growing root systems.

A further object of the invention is to provide an improved tillage tool which is mechanically rugged in its construction, and requires a minimum of maintenance during its operating life.

A further object of the invention is to provide a tillage tool which includes certain parts subjected to extensive wear, which parts can be quickly and easily removed and replaced when the parts become abraided to the point of inefficient operation.

Another object of the invention is to provide a tillage tool which incorporates maximum moisture at root level in the ground, with relatively lesser power required to draw the tool, and less time required per acre.

Additional objects and advantages of the invention will become apparent as the following detailed description of the invention is read, along with a perusal of the accompanying drawings which illustrate a preferred embodiment of the invention.

GENERAL DESCRIPTION OF THE DRAWINGS

DETAILED DESCRIPTION OF THE PREFERRED EMBODIMENT OF THE INVENTION

Figure 1:
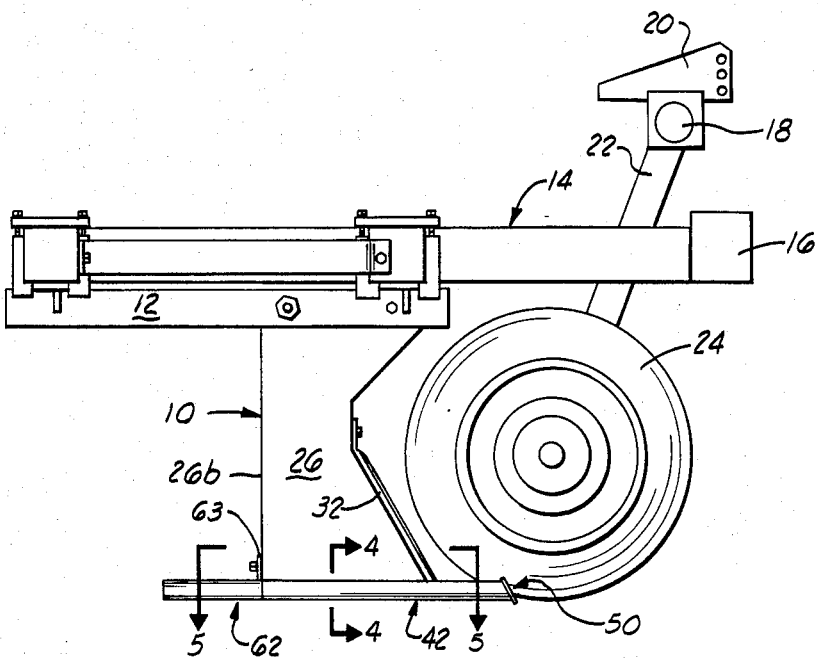
FIG. 1 is a side elevation view of the tillage tool of the invention as it appears when secured to a framework adapted to be towed behind a vehicle such as a farm tractor, and further showing one of the gauge wheels utilized for adjusting and setting the depth at which the tillage tool is pulled through the earth.

The tillage tool of the invention is illustrated in FIG. 1 and is there denominated generally by reference numeral 10. The tillage tool is shown bolted between a pair of plates 12 secured on a framework 14 which includes a forward draw bar 16. Mounted on the framework 14 in any suitable and conventional fashion is a gauge wheel shaft 18 which is mounted for rotation about a horizontal axis. The gauge wheel shaft 18 carries a drive bracket 20 which is apertured to facilitate connection to a suitable hydraulic cylinder or other power device susceptible to operation from a tractor or other vehicle used to tow the frame 14 and the tillage tool 10 attached thereto. An arm 22 extends from the shaft 18 to a gauge wheel 24. In general, at least two gauge wheels 24 are connected by two of the arms 22 to the shaft 18 in this manner. As is well understood in the art, the frame 14 may be raised or lowered in relation to the ground by elevating or lowering the gauge wheels 24 on which the frame is supported. Lowering of the frame 14 in turn sets the tillage tool 10 at a lower depth in the earth and the tool can be adjusted in this fashion to any depth at which it is desired to form an underground tunnel in the earth for the purpose of holding and conveying water through the earth.

Figures 2, 4:
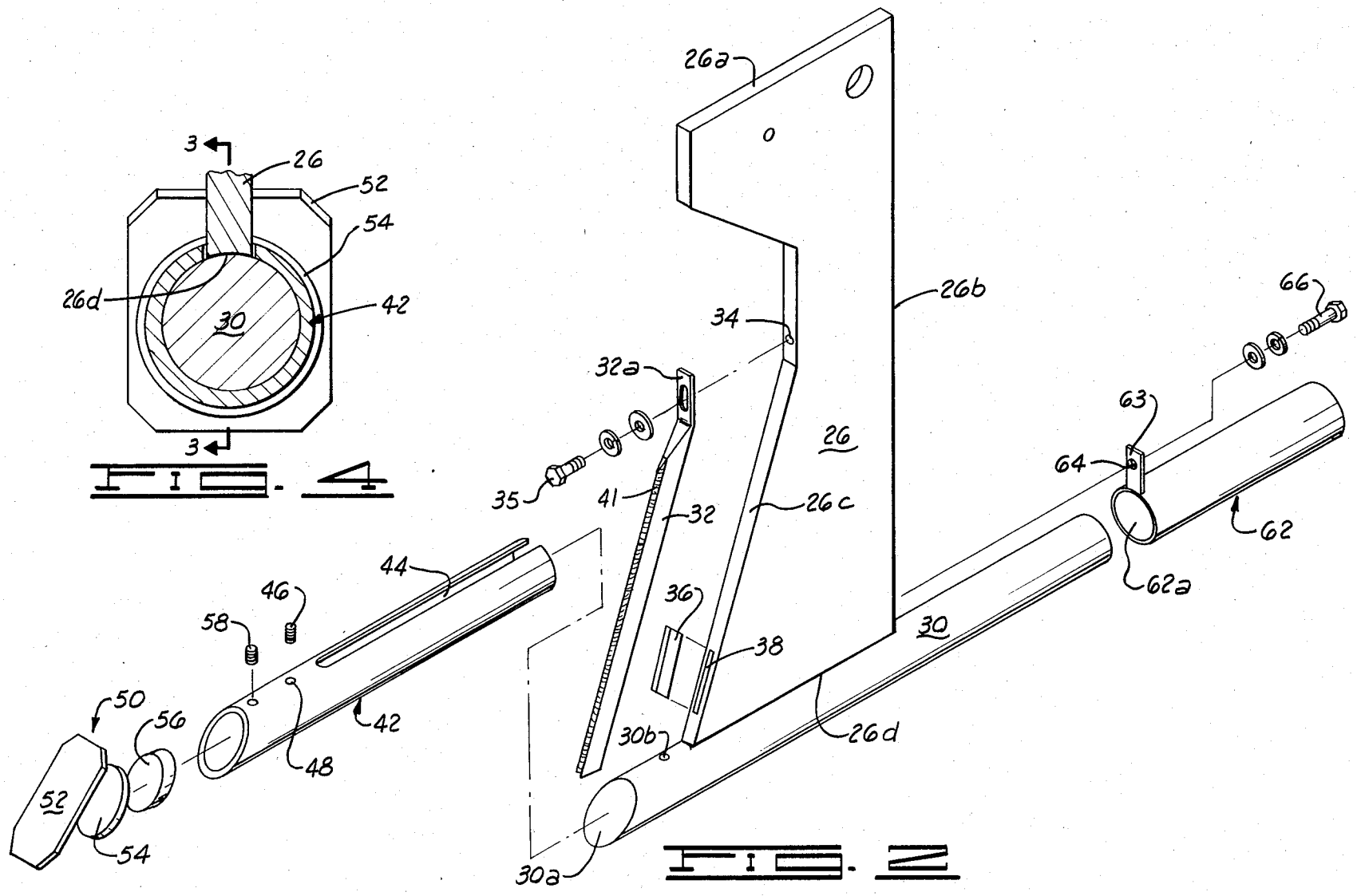
FIG. 2 is an exploded view of the tillage tool of the invention, with parts separated and shown in perspective to illustrate the manner in which the tillage tool is constructed and assembled.
FIG. 4 is a sectional view taken along line 4—4 of FIG. 1.

The tillage tool 10 includes a vertically extending shank plate 26 which projects upwardly to an upper edge **26*a* positioned between the plates 12, and the upper portion of the shank plate is bolted between the plates 12 forming a part of the frame 14. The shank plate 26 further includes a vertically extending rear edge 26*b* and a downwardly and forwardly inclined lower forward edge 26*c*. A lower, horizontally extending edge 26*d* of the shank plate 26 is welded or otherwise suitable secured to a horizontally extending, generally cylindrical mounting bar 30, as shown in FIG. 2. At its forward end, the mounting bar 30 is cut through on a bias to form an inclined, oval-shaped forward face 30*a*. Just to the rear of the forward face 30*a* of the mounting bar 30, the mounting bar has an internally threaded radially extending bolt hole 30*b*** formed therein for a purpose hereinafter described.

Figure 5:
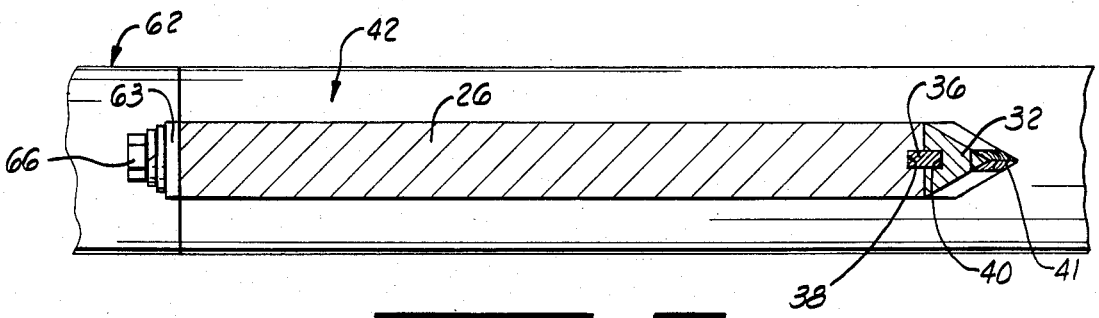
FIG. 5 is a sectional view taken along line 5—5 of FIG. 1.

A slicer bar 32 having a generally trapezoidally-shaped cross-sectional configuration is secured to the forward edge **26*c* of the vertically extending shank plate 26. The manner of securement of the slicer bar 32 to the shank plate 26 is best illustrated in FIGS. 2 and 5. Here it will be noted that the slicer bar 32 has an apertured toe portion 32*a* at its upper end which is adpated to bear against, and have its aperture mate with, an internally threaded bolt hole 34 formed in the front side of the shank plate 26. The bolt hole 34 receives a threaded bolt 35 used to fasten the slicer bar 32 to the shank plate 26. The lower portion of the slicer bar 32 is slotted near the lower end thereof to allow a key 36 to be utilized to hold the slicer bar to the edge 26*c* of the shank plate. The key 36 accomplishes this by having a portion which extends into a keyway slot 38 formed in the lower portion of the forward edge 26*c* of the shank plate 26, and a portion which extends into a keyway slot 40 formed in the backside of the slicer bar 32 as shown in FIG. 5. The lower end of the slicer bar 32 is cut along an angle such that when the slicer bar is mounted on the forward side of the vertically extending shank plate 26, the lower end of the slicer bar mates with and abuts against the top side of the mounting bar 30**.

A triangularly cross-sectional strip 41 of chromium carbide hard facing material is secured to the exposed leading edge of the slicer bar 32. This hardened wear plate is shaped to relieve wear where the shank is welded to the mounting bar, and protects the slicer bar 32 where it bears against the mounting bar.

A slotted, cylindrical forward trenching sleeve 42 is dimensioned to have an internal diameter which permits it to fit snugly over the cylindrical mounting bar 30. The forward trenching sleeve 42 has an elongated axial sot 44 extending forwardly in the upper side of the trenching sleeve from the rear side thereof. The width of the slot 44 is such that it will receive the vertically extending shank plate 26, and the length of the sleeve 42 is such that its forward end is located very slightly ahead of the forward face 30*a* of the cylindrical mounting bar 30 at a time when the rear end is aligned with the rear edge 26*b* of the shank plate 26. The forward sleeve 42 is secured to the mounting bar 30 by means of a threaded screw 46 which is extended through an opening 48 near the front end of the forward sleeve and into the internally threaded hole 30*b* formed in the top side of the mounting bar 30.

Figure 3:
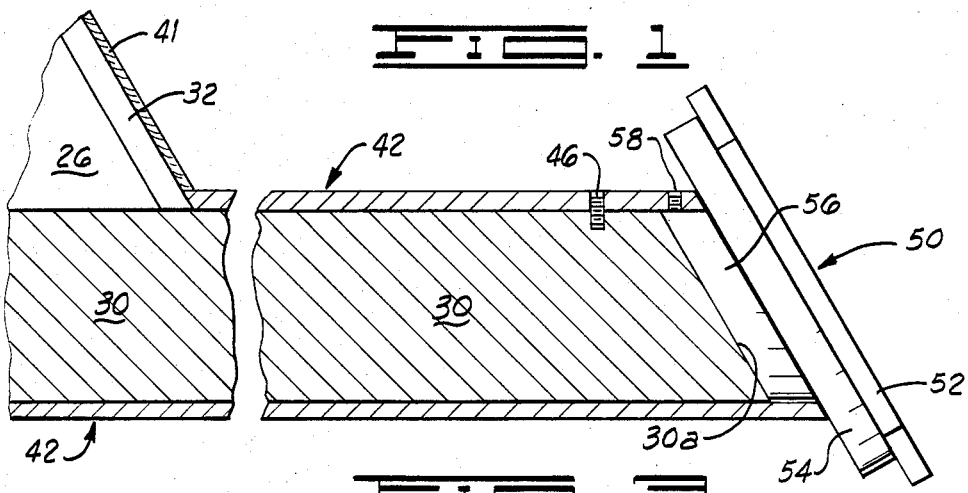
FIG. 3 is a sectional view taken along line 3—3 of FIG. 4.

The forward end of the forward sleeve 42 is closed by means of a plowcap assembly designated generally by reference numeral 50. The plowcap assembly 50 is best illustrated in FIGS. 2 and 3, and includes a chromium carbide wear plate 52 and an oval-shaped facing plate 54 which is, as shown in FIG. 3, larger than the open forward end of the forward sleeve 42 and larger than the oval-shaped front face 30*a* of the mounting bar 30. An insert plate 56 is dimensioned to slide snugly into the open forward end of the forward sleeve 42.

When the plowcap assembly 50 is assembled and is in its operative position, the wear plate 52 is welded to the facing plate 54 which is in turn welded to the insert plate 56. The insert plate 56 is pressed into the open forward end of the forward sleeve 42 and is held in this position by a set screw 58 which is threaded into an internally threaded opening formed in the forward sleeve 42 and bears against the outer side of the insert plate 56 as shown in FIG. 3.

A rear cylindrical trenching sleeve 62 has an internal diameter substantially equal to the outside diameter of the mounting bar 30. The rear end of the rear sleeve 62 is open, but may be closed by a suitable closure plate, and the forward end is open as shown at 62*a*. The rear sleeve 60 is pressed over the rear end portion of the mounting bar 30 and is slid forward on the mounting bar until the forward end of the rear sleeve abuts the rear end of the forward sleeve 42 as shown in FIG. 1. The rear sleeve 62 is secured in position on the mounting bar 30 by means of a vertically extending securement strap 63 carried at the forward end of the rear sleeve and having an aperture 64 formed therein to receive a threaded bolt 66 which is threaded into an internally threaded bolt opening formed in the rear edge 26*b* of the shank 26.

OPERATION

In the use and operation of the tillage tool of the invention, the vertically extending shank plate 26 is bolted along its upper edge to a frame adapted to be pulled behind an agricultural vehicle, which frame can be adjusted in its vertical position above the ground by means of gauge wheels. This method of controlling the depth of plows and similar earth-working devices is well known in the art. The drawings of the application depict the vertically extending shank plate 26 secured in a typical fashion between a pair of horizontally extending plates 12 which form a part of a framework 14 which includes a forward draw bar 16 used to connect the framework to a farm tractor.

By adjusting the gauge wheels 24 through the pivotation of the bracket 20, the depth to which the mounting bar 30, and the forward trenching sleeve 22 and rear trenching sleeve 62 carried thereon will move through the earth can be adjusted to a desired depth. Once the desired setting has been accomplished by the setting of the gauge wheels 24, the framework is pulled behind the tractor so that the shank plate 26, the slicer bar 32 carried thereon and the mounting bar and its associated trenching sleeves are pulled through the earth. The slicer bar, by reason of the sharpened forward edge thereof cuts cleanly through the earth and makes a vertically extending slot or channel which extends down to a location where a tunnel is being formed by the trenching sleeve, and more particularly, the plow cap assembly which is carried on the forward end of the forward trenching sleeve 40. The chromium carbide wear plate 52 which forms a part of plow cap assembly is a very hard material, and its shape permits it to cut cleanly through the earth without excessive resistance. Moreover, its shape also aids in forming a tunnel which will not readily collapse and fill up after the forward and rear trenching sleeves have passed through the opening formed ahead of them by the advancing wear plate.

The treching sleeves 42 and 62, being of equal diameter from front to rear in a horizontal direction, aid in shaping and maintaining the side walls of the tunnel in a compact status so that they do not collapse inwardly once the tool has passed along the section of the earth.

Importantly, the parts of the tillage tool of the present invention which are subjected to the greatest wear can be quickly and easily removed from the tool and replaced any time that this may be desirable. Thus, the slicer bar can be easily removed from the forward side of the shank plate 26 by removal of the bolt 35 and then prying the slicer bar away from the shank plate to disengage the key 36 from its engagement with the slots in the rear side of the slicer bar and the forward side of the shank plate. The slicer bar may then be replaced by a new slicer bar.

At such time as the wear plate may become abraided to the point of fracturing or becoming inefficient, it can be quickly replaced by replacing the entire plow cap assembly 50. This is achieved by merely loosening the set screw 58 by which the plow cap assembly is held on the forward end of the forward sleeve 42.

Both the forward and rear trenching sleeves, 42 and 62, can be replaced easily at any time, in the event they become worn or fractured.

All of the replaceable parts are hardened, and will scour to a high polish finish, thus reducing frictional resistance of the soil to passage of the tool, and therefore reducing the power requirements.

The tillage tool of the invention provides a very useful implement for assuring that the soil efficiently retains in a place most effective for agricultural purposes, any rainfall or water which is stored at a location where the roots of growing plants can easily have access to the water. The water, in being channeled into the underground, horizontally extending tunnels, is not subject to evaporation due to the heat of the sun, and its rate of penetration into the soil from the tunnels is increased so as to be more available to the roots of the plants. The formation of the tunnels by the tillage tool holds the water in place until it has time to be absorbed into the soil. In general, the moisture will spread about 18 inches each way from the tunnels. Further, the vertically extending channels or slots, which place the underground tunnels in communcation with the surface, tend to retain their shape without blockage by caving earth, since the earth is forced back and fractured as it is wedged outwardly and upwardly by the passage therethrough of the slicer bar and the shank plate to which it is mounted. All of the soil will then settle back to leave the surface in substantially its original state.

Although a preferred embodiment of the invention has been herein described, it will be understood that various changes can be made in the described structure without departure from the basic principles which underlie the invention. Changes and innovations of this type are therefore deemed to be circumscribed by the spirit and scope of the invention, except as the same may be limited by the appended claims or reasonable equivalents thereof.

What is claimed is:

1. A tillage tool for forming an underground tunnel communicating with the surface by a narrow slot comprising:

a vertically extending shank plate having an upper end portion adapted for attachment to a horizontally extending frame, and having a lower edge, a forward edge and a rear edge;

an elongated, horizontally extending cylindrical mounting bar secured to the lower edge of the shank plate and having a beveled forward face;

a forward cylindrical sleeve demountably telescoped over the forward end portion of said mounting bar and having a horizontally extending slot formed therein which receives said shank plate, said forward sleeve being cut transversely on a bevel at its forward end matching that of said beveled forward face;

a plow cap assembly secured to the beveled forward end of said forward sleeve and including a wear plate extending across the forward end of said forward sleeve at the angle of said beveled forward face;

a tubular rear sleeve of the same outside diameter as said forward sleeve telescoped over the rear end portion of said horizontally extending mounting bar and abutting at its forward end, the rear end of said forward sleeve;

a slicer bar detachably secured to the forward edge of said vertically extending shank plate; and a strip of hard facing material secured to the leading edge of said slicer bar.

* * * * *